US008375645B2

(12) United States Patent
Iwauchi et al.

(10) Patent No.: US 8,375,645 B2
(45) Date of Patent: Feb. 19, 2013

(54) SLIDING DOOR DEVICE

(75) Inventors: Kenji Iwauchi, Hiroshima (JP); Masazumi Morishita, Tokyo (JP); Masahito Yamada, Tokyo (JP)

(73) Assignees: Niitech Co., Ltd., Hiroshima (JP); Sugatsune Kogyo Co., Ltd., Tokyo (JP)

( * ) Notice: Subject to any disclaimer, the term of this patent is extended or adjusted under 35 U.S.C. 154(b) by 274 days.

(21) Appl. No.: 12/530,335

(22) PCT Filed: Mar. 3, 2008

(86) PCT No.: PCT/JP2008/053782

§ 371 (c)(1),
(2), (4) Date: Apr. 22, 2010

(87) PCT Pub. No.: WO2008/108340

PCT Pub. Date: Sep. 12, 2008

(65) Prior Publication Data

US 2010/0205865 A1 Aug. 19, 2010

(30) Foreign Application Priority Data

Mar. 5, 2007 (JP) ..... 2007-054738

(51) Int. Cl.
*E05D 15/10* (2006.01)
*E05D 13/00* (2006.01)
*E06B 3/32* (2006.01)

(52) U.S. Cl. ..... 52/29; 52/207; 49/127; 49/209; 49/213; 49/409

(58) Field of Classification Search ..... 52/207, 52/204.51, 29, 243.1; 49/209, 211, 213, 49/425, 409–411, 125, 127–130
See application file for complete search history.

(56) References Cited

U.S. PATENT DOCUMENTS 2,170,870 A * 8/1939 Nichols ..... 49/212
2,784,445 A * 3/1957 Greig et al. ..... 16/105
2,815,543 A * 12/1957 Gates ..... 49/411
(Continued)

FOREIGN PATENT DOCUMENTS

DE 34 02 947 A1 * 8/1984
EP 2 130 999 A1 * 12/2009
(Continued)

OTHER PUBLICATIONS

International Search Report—PCT/JP2008/053782—Apr. 15, 2008.

*Primary Examiner* — Robert Canfield
(74) *Attorney, Agent, or Firm* — Young & Thompson

(57) ABSTRACT

A sliding door device has a first pin body provided, at a floor surface; a guide member provided at the door and having a guide groove in which the first pin body fits when the door is closed; and a second pin body that is provided on the floor surface and can be fit in a door groove formed at the door bottom. When the closed door slides in an opening direction and toward the back side of the wall surface, the guide member moves relatively along the first pin body while the first pin body is fit in the guide groove of the guide member. When the door slides further in the opening direction, the second pin body gets in the door groove of the door, and the door slides along the second pin body while the second pin body is fit in the sliding groove of the door.

9 Claims, 14 Drawing Sheets

U.S. PATENT DOCUMENTS

| | | | | | |
|---|---|---|---|---|---|
| 2,929,115 | A | * | 3/1960 | Beckstrom | 49/411 |
| 3,296,744 | A | * | 1/1967 | Hentzi | 49/409 |
| 3,591,984 | A | * | 7/1971 | Lauterbach | 49/220 |
| 3,611,637 | A | * | 10/1971 | Saino | 49/235 |
| 4,176,497 | A | * | 12/1979 | Nagy | 49/411 |
| 4,404,770 | A | * | 9/1983 | Markus | 49/235 |
| 4,467,562 | A | * | 8/1984 | Hemmerling | 49/411 |
| 4,476,652 | A | * | 10/1984 | Beauchot | 49/235 |
| 4,619,075 | A | * | 10/1986 | Wiles | 49/235 |
| 4,688,352 | A | * | 8/1987 | Kinoshita | 49/209 |
| 5,327,681 | A | * | 7/1994 | Minami | 49/411 |
| 5,341,600 | A | * | 8/1994 | Heppner | 49/471 |
| 5,351,442 | A | * | 10/1994 | Gingras | 49/411 |
| 6,098,341 | A | * | 8/2000 | Gebauer | 49/226 |
| 6,497,072 | B2 | * | 12/2002 | Fries | 49/209 |
| 7,346,939 | B2 | * | 3/2008 | Perry | 4/557 |
| 7,520,090 | B2 | * | 4/2009 | Gerhart | 49/425 |
| 7,610,718 | B2 | * | 11/2009 | Kopish | 49/211 |
| 7,647,728 | B2 | * | 1/2010 | Bortoluzzi | 49/209 |
| 8,112,954 | B2 | * | 2/2012 | Gosling et al. | 52/207 |
| 8,113,607 | B2 | * | 2/2012 | Slager et al. | 312/304 |
| 8,181,394 | B2 | * | 5/2012 | Michaels | 49/409 |

FOREIGN PATENT DOCUMENTS

| | | | |
|---|---|---|---|
| JP | 53-20638 | * | 2/1978 |
| JP | 61-28881 | | 2/1986 |
| JP | 3-2483 | * | 1/1991 |
| JP | 4-23074 | | 4/1992 |
| JP | 8-319763 | * | 12/1996 |
| JP | 8-338170 | * | 12/1996 |
| JP | 10-37580 | * | 2/1998 |
| JP | 11-131906 | * | 5/1999 |
| JP | 2000-8691 | | 1/2000 |
| JP | 2002-129824 | * | 5/2002 |
| JP | 2004-225436 | * | 8/2004 |
| JP | 2005-133285 | * | 5/2005 |
| JP | 3686617 | | 8/2005 |
| JP | 2006-233676 | * | 9/2006 |
| JP | 2007-277877 | * | 10/2007 |
| JP | 2007-277878 | * | 10/2007 |
| JP | 2008-223456 | * | 9/2008 |
| JP | 2008-285942 | * | 11/2008 |
| JP | 2008-308968 | * | 12/2008 |
| JP | 2009-150151 | * | 7/2009 |
| RU | 2 049 681 C1 | * | 12/1995 |

* cited by examiner

SLIDING DOOR DEVICE

TECHNICAL FIELD

The present invention relates to a sliding door device for a sliding door that opens and closes by sliding from side to side, and more particularly to a sliding door device capable of arranging a front surface of a sliding door and a wall surface to be flat when the sliding door is in a closed position and arranging the sliding door in an open position on the back side or front side of the wall surface in parallel with the wall surface.

BACKGROUND ART

In a related art, there is a sliding door that opens and closes by sliding from side to side in a groove between a door lintel and a doorsill. Such a sliding door only slides straightly in a horizontal direction and when the sliding door is to be placed at the back side or front side of a wall surface, the front surface of the sliding door in the closed position and the wall surface cannot be flat or arranged in the same plane. This causes a problem of bad appearance.

In order to solve this problem, Japanese Patent No. 3686617 discloses a sliding door device having a curved guide rail 32 attached to a part above a sliding door 31 and rollers 33 attached to the sliding door 31 to roll in the guide rail 32, which is illustrated in FIG. 14. With this sliding door device, as the sliding door 31 moves along the curved guide rail 32, the surface of the sliding door 31 in the closed position and the wall surface can be flat and the sliding door 31 in the open position can be arranged on the back side of the wall surface.

Besides, in this sliding door device, there is no guide groove on a floor surface for guiding a lower part of the sliding door. Instead of the groove provided in the floor surface, a sliding door groove 31*a* is provided in the bottom surface of the sliding door 31, and in the floor surface, a pin body 34 is provided that fits into the sliding door groove 31*a* in the bottom surface of the sliding door 31. This is because when the guide groove is provided in the floor surface, dust will easily accumulate therein. When the sliding door in the closed position is to be opened, the pin body 34 fits into the sliding door groove 31*a*. The opening motion of the sliding door 31 is guided by the pin body 34. As it is not preferable that the pin body 34 juts in the opening which people pass through, the pin body 34 is arranged hidden behind the wall surface.

Japanese Patent No. 3686617 (claim 1, FIGS. 1 and 4)

DISCLOSURE OF THE INVENTION

Problem to be Solved by the Invention

However, when the pin body 34 is arranged behind the wall surface, it cannot support the lower part of the sliding door 31 in the closed position. As the sliding door 31 is only suspended by the curved guide rail 32 provided above, the sliding door becomes floating when it is in the closed position. In addition, when the sliding door 31 in the closed position is to be opened, the pin body 34 is difficult to fit into the sliding door groove 31*a* as the lower part of the sliding door is not fixed.

Then, the present invention provides a sliding door device capable of guiding opening and closing motions of a sliding door and preventing shaking of a lower part of the sliding door when the sliding door is closed.

Means for Solving the Problem

A description on the present invention will now be given hereunder. For easy understanding of the present invention, the reference numerals in the accompanying drawings are indicated herein with bracketed numerals which, however, are not intended to limit the present invention to the forms illustrated in the drawings.

In order to solve the problem, the first embodiment is a sliding door device capable of making a surface of a sliding door (3) in a closed position in plane with a wall surface and arranging the sliding door (3) in an open position on a back side or a front side of the wall surface and in parallel with the wall surface, the sliding door device comprising: a first pin body (16) provided at one of the sliding door (3) and a floor surface; a guide member (11) provided at an other of the sliding door (3) and the floor surface and having a guide groove (13*a*) in which the first pin body (16) fits when the sliding door (3) is in the closed position; and a second pin body (17) that is provided on the floor surface and can be fit in a sliding door groove (3*a*) formed at a bottom part of the sliding door (3), in which, when the sliding door (3) in the closed position is slid in an opening direction and toward the back side or front side of the wall surface, the guide member (11) moves relatively along the first pin body (16) while the first pin body (16) is fit in the guide groove (13*a*) of the guide member (11), and when the sliding door (3) is further slid in the opening direction, the second pin body (17) gets in the sliding door groove (3*a*) of the sliding door (3) and the sliding door (3) slides along the second pin body (17) while the second pin body (17) is fit in the sliding groove (3*a*) of the sliding door (3).

Here, the wall surface may be a wall surface of a fixed wall, or when two sliding doors are provided adjacent to each other, the wall surface may be a wall surface of an adjacent sliding door.

In a further embodiment, after the second pin body (17) gets in the sliding door groove (3*a*) of the sliding door (3), the first pin body (16) gets out of the guide groove (13*a*) of the guide member (11).

The next embodiment is a sliding door device capable of making a surface of a sliding door (3) in a closed position in plane with a wall surface and arranging the sliding door (3) in an open position on a back side or a front side of the wall surface and in parallel with the wall surface, the sliding door device comprising: a first pin body (16) provided at one of the sliding door (3) and a floor surface; a guide member (11) provided at an other of the sliding door (3) and the floor surface and having a guide groove (13*a*) in which the first pin body (16) fits when the sliding door (3) is in the closed position; and a second pin body (17) that is provided, on a bottom part of the sliding door (3) and can be fit in a floor surface side guide groove formed on the floor surface, in which, when the sliding door (3) in the closed position is slid in an opening direction and toward the back side or front side of the wall surface, the guide member (11) moves relatively along the first pin body (16) while the first pin body (16) is fit in the guide groove (13*a*) of the guide member (11), and when the sliding door (3) is further slid in the opening direction, the second pin body (17) gets in the floor surface side guide groove of the floor surface and the sliding door (3) slides along the floor surface side guide groove of the floor surface while the second pin body (17) is fit in the floor surface side guide groove of the floor surface.

In the next embodiment, the first pin body (16) is provided on the floor surface and the guide member (11) is provided on the sliding door (3).

In the next embodiment, the first pin body (16) does not jut in an opening (14) when seen from a front side of the sliding door (3) and at least a part of the guide member (11) protrudes in a width direction of the sliding door (3) when seen from the front side of the sliding door (3).

In the next embodiment, the guide member (11) is provided with a door stopper (12*c*) at the part of the guide member (11) protruding in the width direction of the sliding door (3) when seen from the front side of the sliding door (3).

The next embodiment is a sliding door device capable of making a surface of a sliding door (3) in a closed position in plane with a wall surface and arranging the sliding door (3) in an open position on a back side or a front side of the wall surface and in parallel with the wall surface, the sliding door device comprising: a first pin body (16) provided at a floor surface; and a guide member (23) provided at the sliding door (3) and having a guide groove (23*a*) in which the first pin body (16) fits when the sliding door (3) is in the closed position; wherein the guide member (23) moves along the first pin body (16) while the first pin body (16) is fit in the guide groove (23*a*) of the guide member (23) when the sliding door (3) moves from the closed position to the open position.

The next embodiment is a sliding door system comprising: the sliding door device of any one of 1 to 7*a*; a frame (1) having a wall surface; and a sliding door (3) accommodated in the frame (1) to be openable and closable.

Effect of the Invention

In the disclosed device, as the first pin body and the second pin body are switched to guide the opening and closing motions of the sliding door, the sliding door is prevented from shaking even when it is in the closed, position and the second pin body is sure to be fit in the sliding door groove of the sliding door.

In the disclosed device, the guide groove of the guide member has required minimum length. This makes it possible to prevent bad appearance of the guide member and reduce the manufacturing cost of the guide member.

In the disclosed device, as the first pin body and the second pin body are switched to guide the opening and closing motions of the sliding door, the sliding door is prevented from shaking even when it is in the closed position and the second pin body of the sliding door is sure to be fit in the floor surface side guide groove on the floor.

In the disclosed device, there is no need to provide the guide member with the guide groove on the floor surface.

In the disclosed device, the first pin body is prevented from jutting into the opening when seen from the front side of the sliding door.

In the disclosed device, the guide member can double as the door stopper.

In the disclosed device, the opening and closing motions of the sliding door from the closed position to the open position and vice versa can be performed by the first pin body, and when the sliding door is in the closed position, the sliding door is also prevented from shaking. Besides, as the guide groove is provided on the sliding door side, not on the floor side, there is no fear of waste or dust accumulating in the guide groove.

EXPLANTION OF REFERENCE NUMERALS

Figure 1:
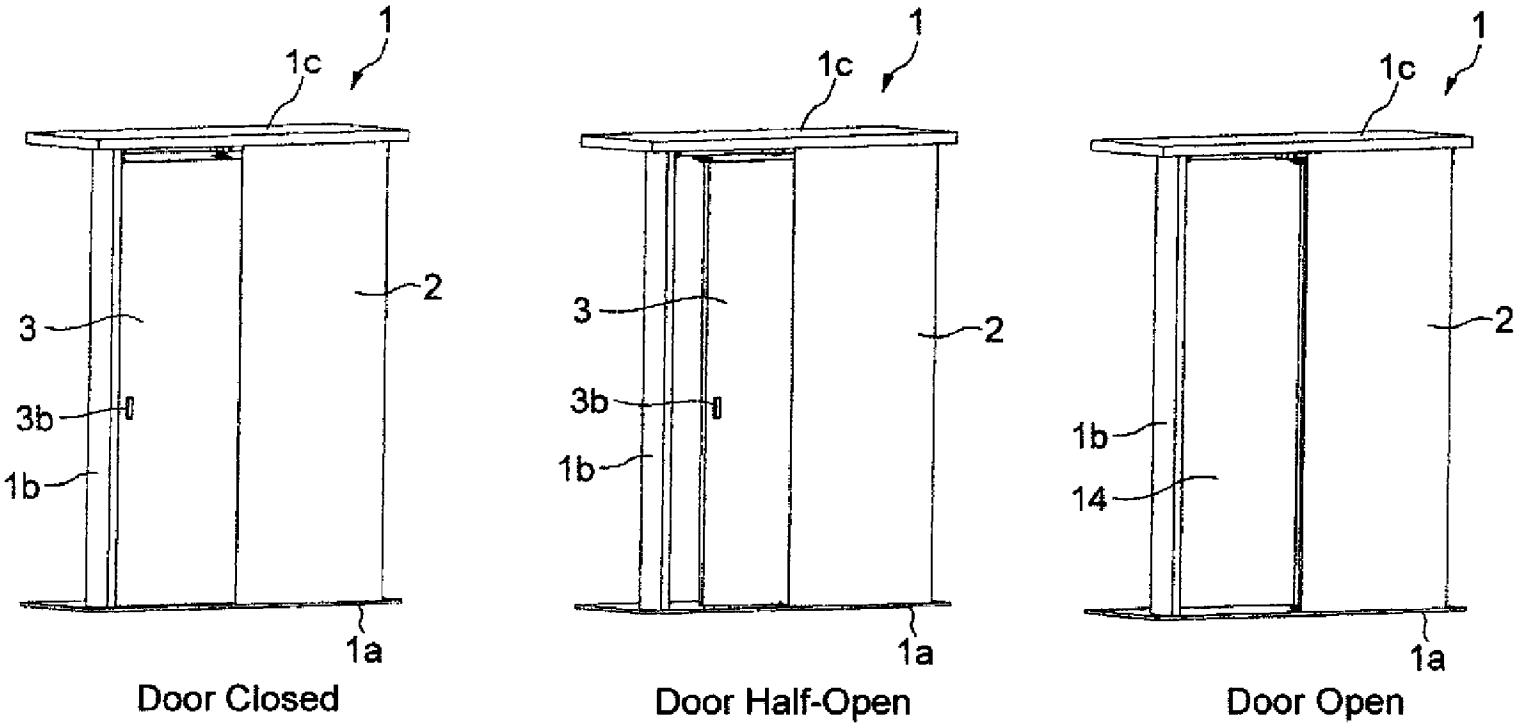
FIG. 1 is a perspective view of a sliding door device according to one embodiment of the present invention (seen from the front side)

1 . . . frame
3 . . . sliding door
3*a* . . . sliding door groove
11 . . . guide member
12*c* . . . door stopper
13*a* . . . . guide groove
16 . . . first pin body
17 . . . second pin body
23 . . . guide member
23*a* . . . guide groove

BEST MODE FOR CARRYING OUT THE INVENTION

Figure 2:
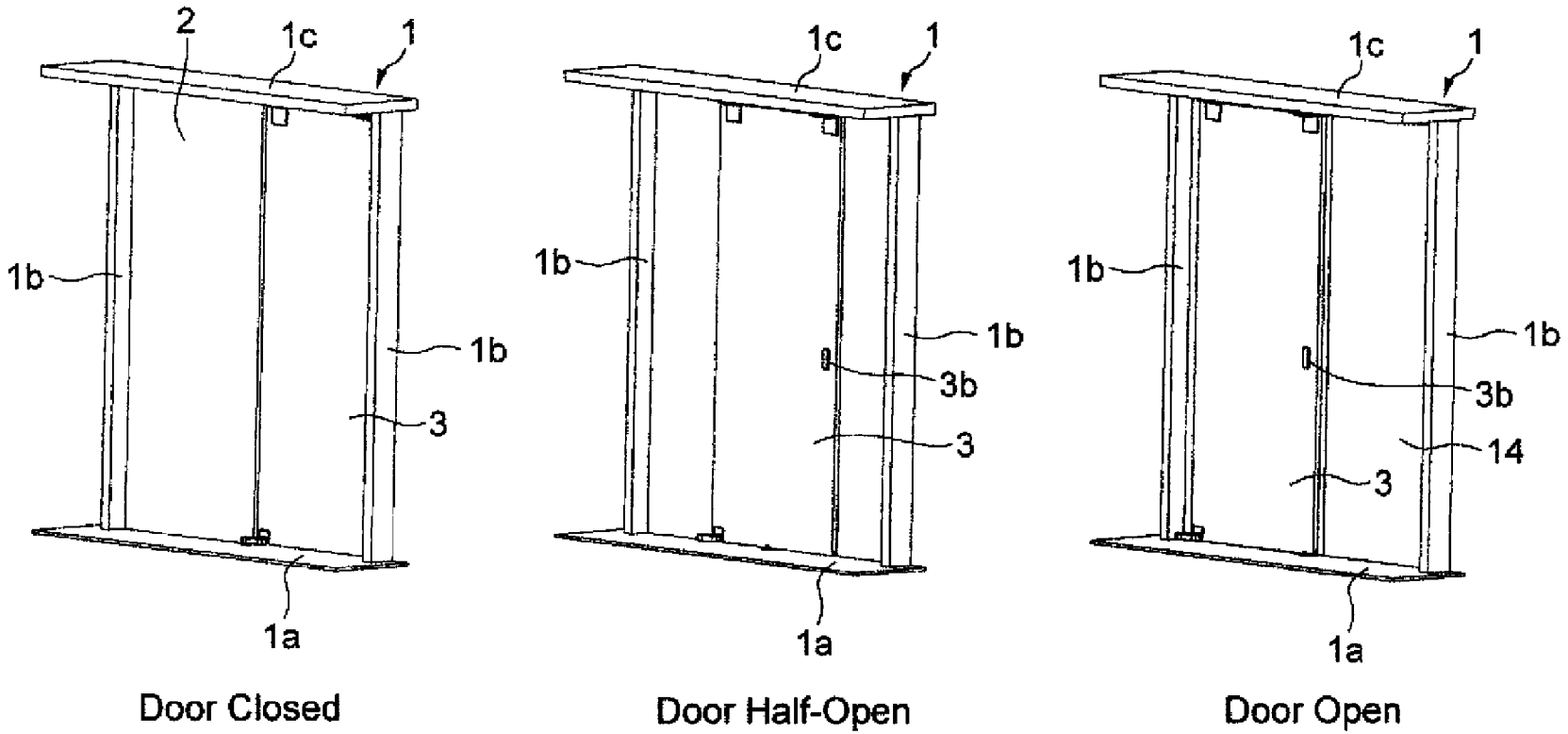
FIG. 2 is a perspective view of the above-mentioned sliding door device (seen from the back side)

With reference to the attached drawings, the sliding door device according to the first embodiment of the present invention will be described below. FIG. 1 is a perspective view of the sliding door device seen from the front side, and FIG. 2 is a perspective view of the sliding door device seen from the back side. The sliding door is placed in a square-shaped frame so as to be opened and closed freely. The frame 1 has a floor part 1*a*, a pair of vertical parts 1*b* extending vertically from the floor part 1*a* and a ceiling part 1*c* provided on the upper ends of the vertical parts 1*b*. Seen from the front side, the right half of the space inside the frame 1 is closed by the wall 2. A sliding door 3 opens and closes an opening 14 at the left half of the space inside the frame 1.

When the sliding door 3 is closed, the sliding door 3 closes the opening 14. The surface of the sliding door 3 in the closed position and the wall surface of the wall 2 are flat or arranged in the same plane. When a knob 3*b* is used to open the sliding door 3, the sliding door 3 slides in the opening direction (in the right direction in FIG. 1) and toward the back of the wall surface, that is, in the obliquely backward direction, while the sliding door 3 is kept in parallel with the wall surface of the wall 2. When the sliding door 3 reaches the backside of the wall 2, the sliding door 3 slides straightly in parallel with the walls surface. When the sliding door 3 is in the open position, the sliding door 3 is hidden behind the wall surface while it is kept in parallel with the wall surface.

Figure 3:
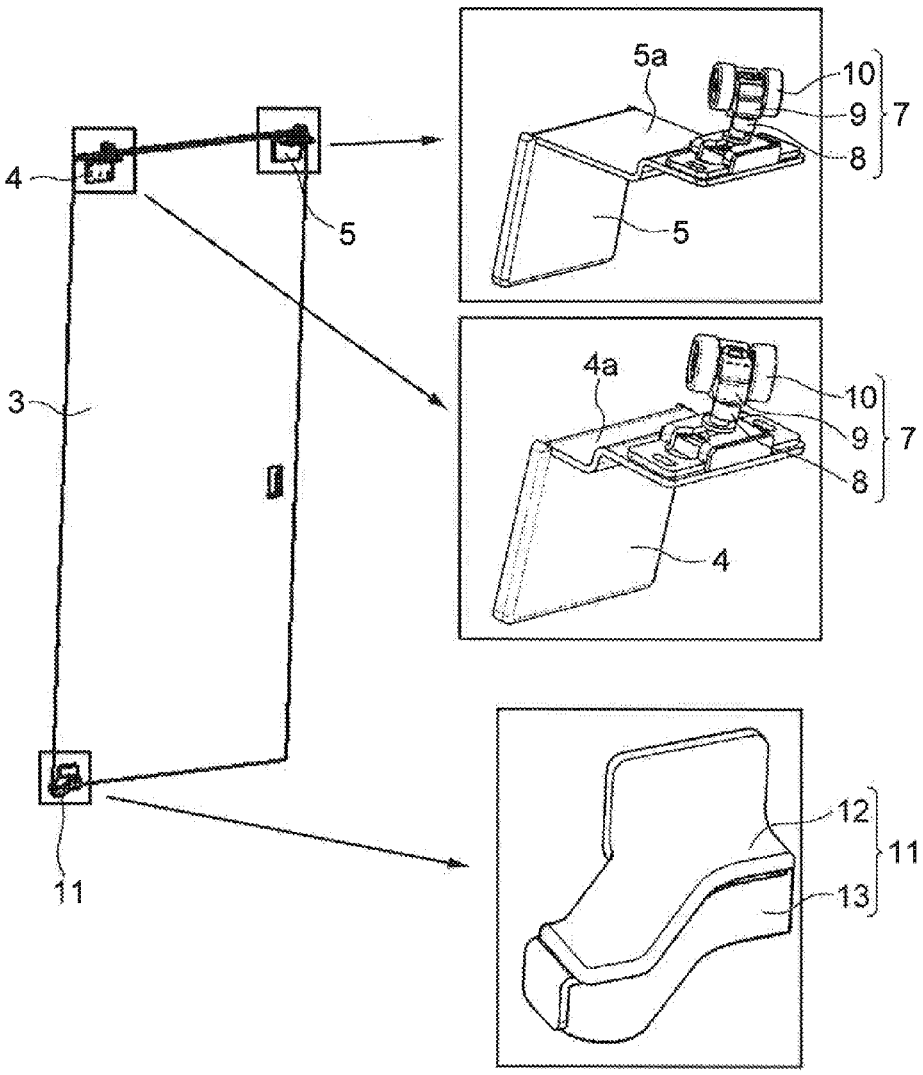
FIG. 3 is a perspective view of a sliding door (including an enlarged view of a guide member and a roller unit)

FIG. 3 is a perspective view illustrating the sliding door 3. A pair of L-shaped brackets 4 and 5 is attached to the upper parts of the sliding door 3, spaced from each other by a predetermined distance in the width direction of the sliding door 3. One L-shaped bracket 4 has a short jutting part 4*a* while the other L-shaped bracket 5 has a long jutting part 5*a*. To these jutting parts 4*a* and 5*a* of the L-shaped brackets 4 and 5, respectively, roller units 7 are attached. Each roller unit 7 has a main shaft 8 extending vertically, a main body 9 rotatable in the horizontal plane relative to the main shaft 8, and rollers 10 provided at respective sides of the main body 9. The rotation center line of the rollers 10 is positioned in the horizontal plane and can rotate in the horizontal plane.

Figure 4:
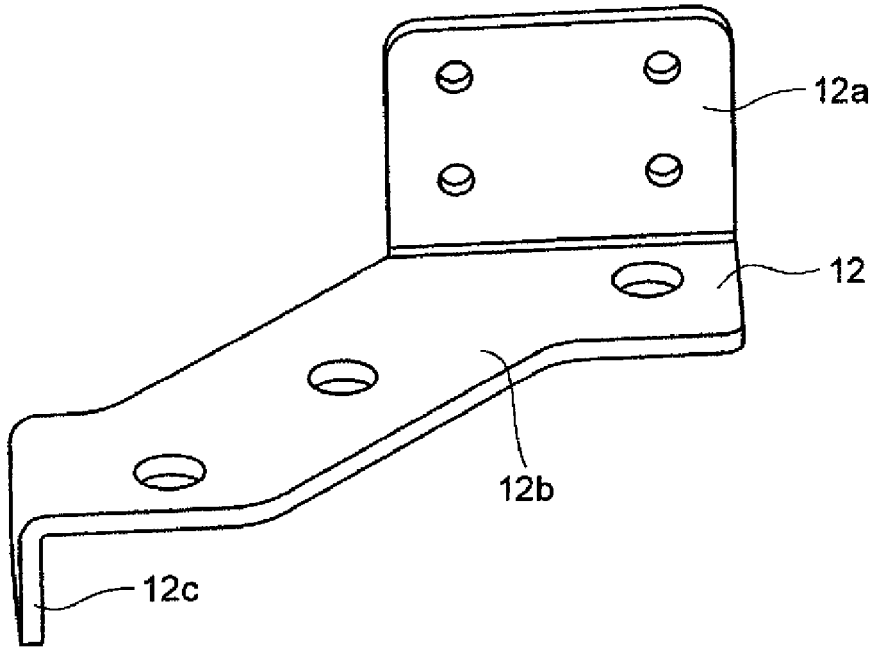
FIG. 4 is an exploded perspective view of the guide member (illustrating a reversed main body of the guide member)
Figure 4:
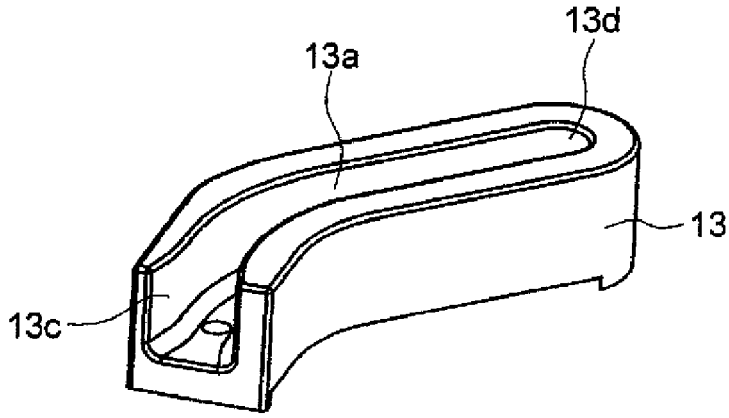

A guide member 11 is attached to an end of the lower part of the sliding door 3 in the opening direction. The guide member 11 has an approximately L-shaped guide groove in the bottom surface thereof. The guide member 11 has a bracket 12 attached to the sliding door 3 and a main body 13 of which the guide groove is formed in the lower part. FIG. 4 is an exploded view of the guide member 11. In FIG. 4, the main body 13 is illustrated upside down. The bracket 12 is bent into approximately L shape and has a sliding door connecting part 12*a* attached to the sliding door 3, and a main body connecting part 12*b* horizontally jutting out of the sliding door connecting part 12*a*. At the end of the main body connecting part 12*b* in the opening direction of the sliding door 3 is provided with a door stopper 12*c* bent downward into the L shape. At the door stopper 12*c*, a cushioning member is attached thereto. When the sliding door 3 is fully open, the cushioning member attached to the door stopper 12*c* is in touch with the vertical part 1*b*.

In the main body 13, the guide groove 13*a* is formed extending into a thin L shape along the approximately L-shaped main body 13. One end 13*c* of the guide grove 13*a* passes through the main body 13. The open end 13*c* of the guide grove 13*a* extends into the tapered shape so that a pin body, described later, may be easily received therein. The other end part 13*d* of the guide groove 13*a* does not pass through the main body.

Figure 5:
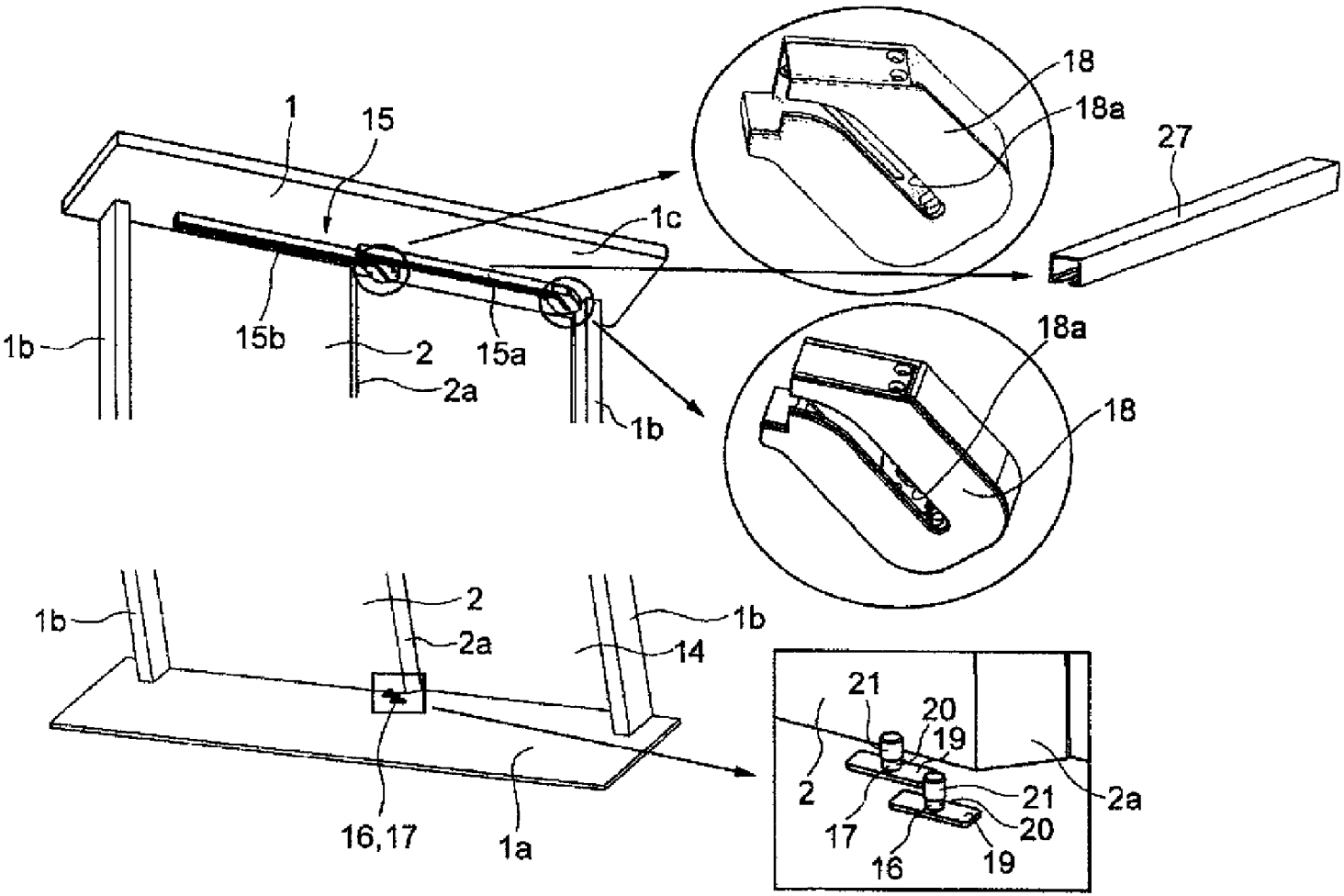
FIG. 5 is a perspective view illustrating the pin body and the guide rail attached to a frame (seen from the back side)

FIG. 5 illustrates pin bodies 16 and 17 and a guide rail 15 attached to the frame 1. In FIG. 5, the frame 1 is illustrated as seen from the back side. At the ceiling part 1*c* of the frame 1, two guide rails 15*a* and 15*b* are attached in parallel with each other. The two roller units 7 move in each of the guide rails 15*a* and 15*b*. The two guide rails 15*a* and 15*b* are arranged displaced from each other in the longitudinal direction thereof in accordance with the movement range of the roller units 7 spaced from each other in the width direction of the sliding door 3. Each of the guide rails 15*a* and 15*b* has a straight rail 27 of C shaped cross section extending straightly and a pulling-in box 18 provided at the end of the sliding door 3 in the closing direction. The pulling-in box 18 has a pair of pulling-in rails 18*a* extending in an oblique direction relative to the straight rail. The pulling-in rails 18*a* in pair are kept in parallel with each other. When closing the sliding door 3, the roller unit 7 moves into the pulling-in box 18, and then, the roller unit 7 is pulled toward the back of the pulling rails 18*a* by a spring force. The pulling-in operation of the pulling-in box 18 continues until the sliding door 3 comes into touch with the vertical part 1*b*. When the sliding door 3 is surely brought into touch with the vertical part 1*b*, the vertical part 1*b* may be provided with a magnet. When closing the sliding door 3, the sliding door 3 moves in the closing direction and toward the front side of the wall surface (back side of the wall 2 as the view of FIG. 5 is seen from the back side), that is, in the oblique direction. In order to prevent the sliding door 3 from interfering with the wall 2, the end surface 2*a* of the wall 2 at the sliding door side is cut obliquely.

At the floor part 1*a* of the frame 1, there are first and second pin bodies 16 and 17 attached thereto. The first and second pin bodies 16 and 17 are provided at the back of the wall 2 seen from the front side of the sliding door 3 and spaced from the opening 14 of the frame 1. The first pin body 16 is arranged at the opening 14 side and farther from the wall 2 than the second pin body 17. Each of the first and second pin bodies 16 and 17 has a rectangular seat part 19, a metal column part 20 extending vertically from the seat part 19 and a rotating part 21 made of resin and covering the upper end part of the column part 20. The rotating part 21 is cylindrical shape having a bottom and is rotatable around the column 20.

Figure 6:
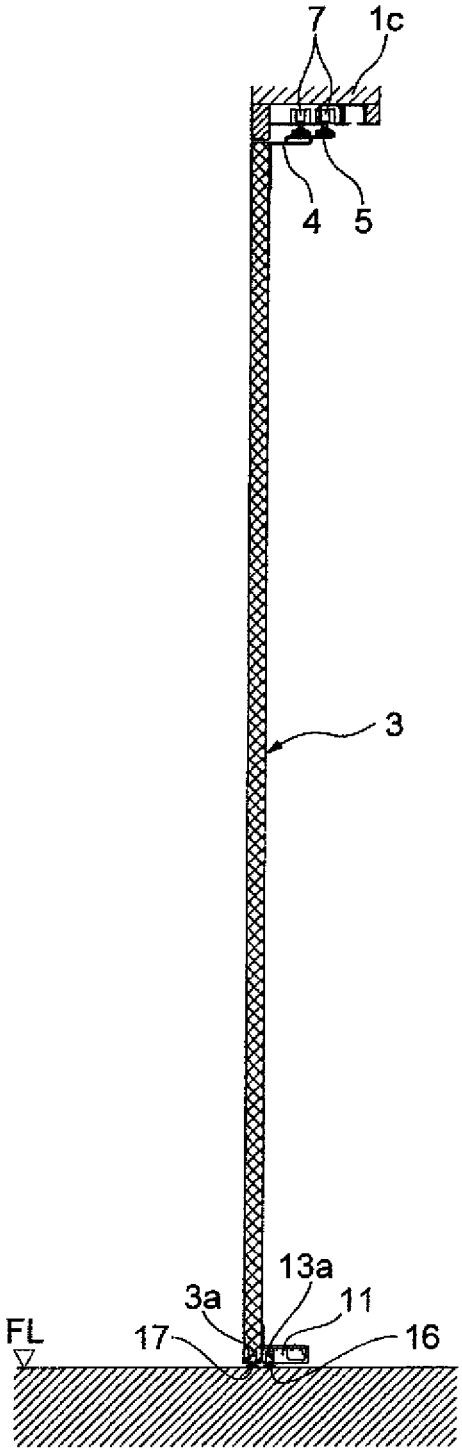
FIG. 6 is a vertical cross-sectional view of the sliding door.

FIG. 6 is a vertical cross-sectional view of the sliding door 3. Illustrated in FIG. 6 is the cross section of the sliding door 3 that is moving slightly in the opening direction from the closed position. At the bottom surface of the sliding door 3, there is formed a thin sliding door groove 3*a* extending in the width direction of the sliding door 3. The second pin body 17 is fit in this sliding door groove 3*a* and the first pin body 16 is fit in the guide groove 13*a* of the guide member 11.

Figure 7:
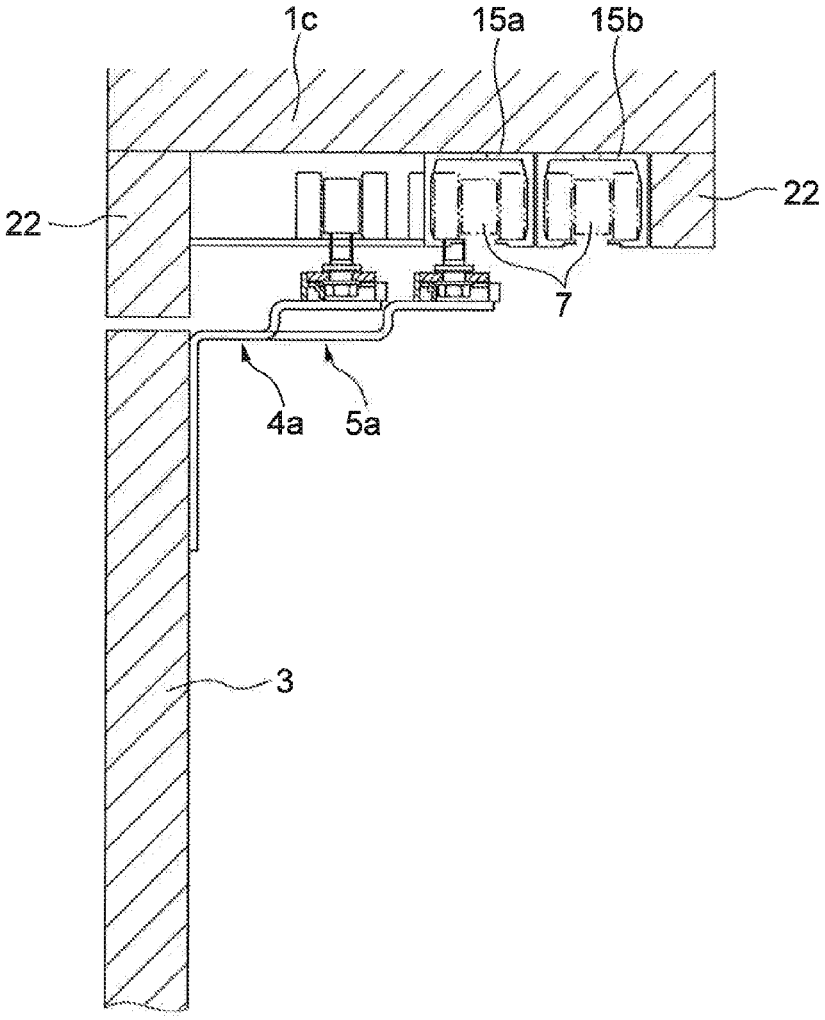
FIG. 7 is a vertical cross-sectional view of an upper part of the sliding door.

FIG. 7 is an upper side cross-sectional view of the sliding door 3. Between door lintels 22 of the ceiling part 1*c*, two guide rails 15*a* and 15*b* are arranged. In each of these two guide rails 15*a*, 15*b*, the two roller units 7 roll. The sliding door 3 is suspended from these two roller units 7. As described above, out of the two L-shaped brackets 4 and 5, the jutting part 4*a* of one bracket 4 is short and the jutting part 5*a* of the other bracket 5 is long. With this configuration, the sliding door 3 can slide in parallel with the wall 2 though these two guide rails 15*a* and 15*b* are arranged different distances away from the sliding door 3.

Figure 8:
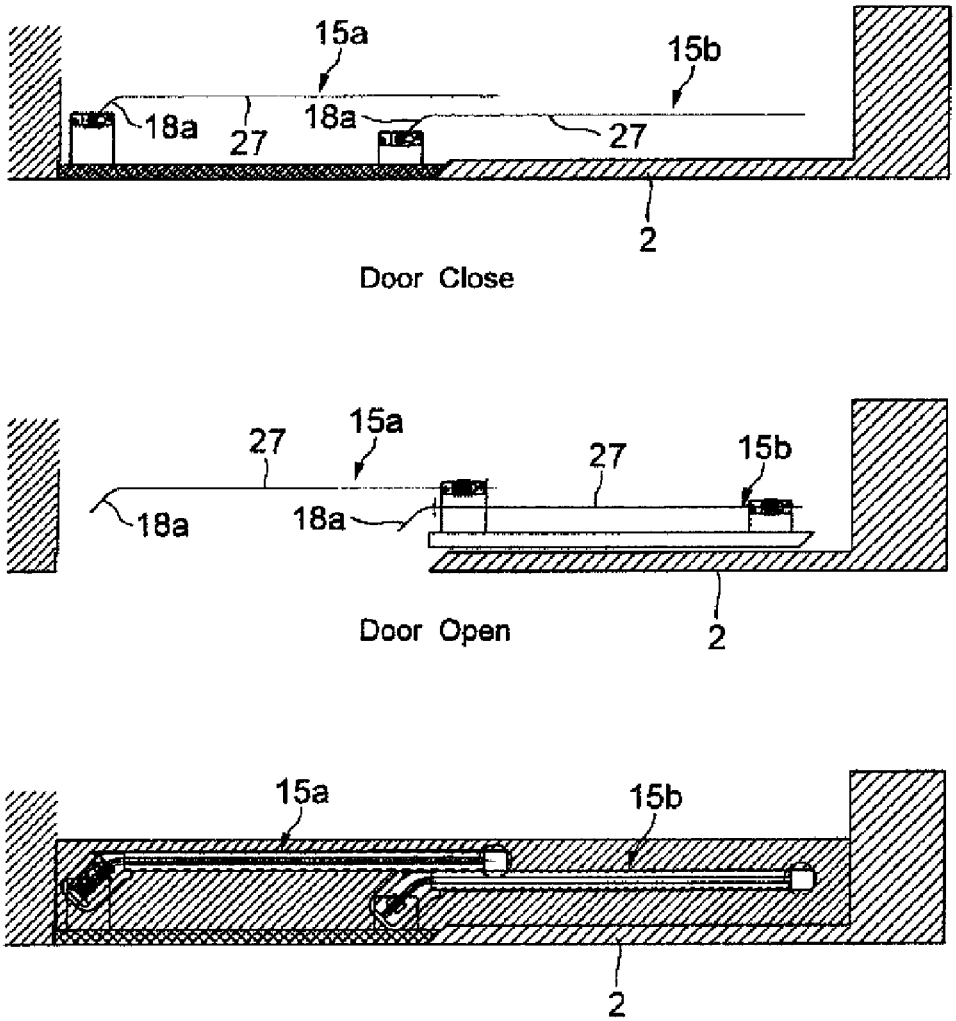
FIG. 8 is a horizontal cross-sectional view illustrating opening and closing motions of the upper part of the sliding door in chronological order.

FIG. 8 is a horizontal cross-sectional view illustrating the opening and closing motions of the upper part of the sliding door 3 in chronological order. As described above, each of the two guide rails 15*a* and 15*b* has the straight rail 27 and the pulling-in rails 18*a* pulling the sliding door 3 obliquely relative to the straight rail 27.

When the sliding door 3 is in the closed position, the surface of the sliding door 3 and the surface of the wall become flat. When the sliding door in the closed position is to be opened, the sliding door 3 slides in the obliquely backward direction along the pulling-in rails 18*a*. Then, the sliding door 3 slides straightly along the straight rail 27 and in parallel with the wall 2. When the sliding door 3 is in the open position, the sliding door 3 is hidden behind the wall 2. When the sliding door 3 in the open position is to be closed, the sliding door 3 slides in the direction opposite to that described above. That is, the sliding door 3 first slides in parallel with the wall 2 and straightly along the straight rail 27 and then, slides in the obliquely frontward direction along the pulling-in rails 18*a*.

Figure 9:
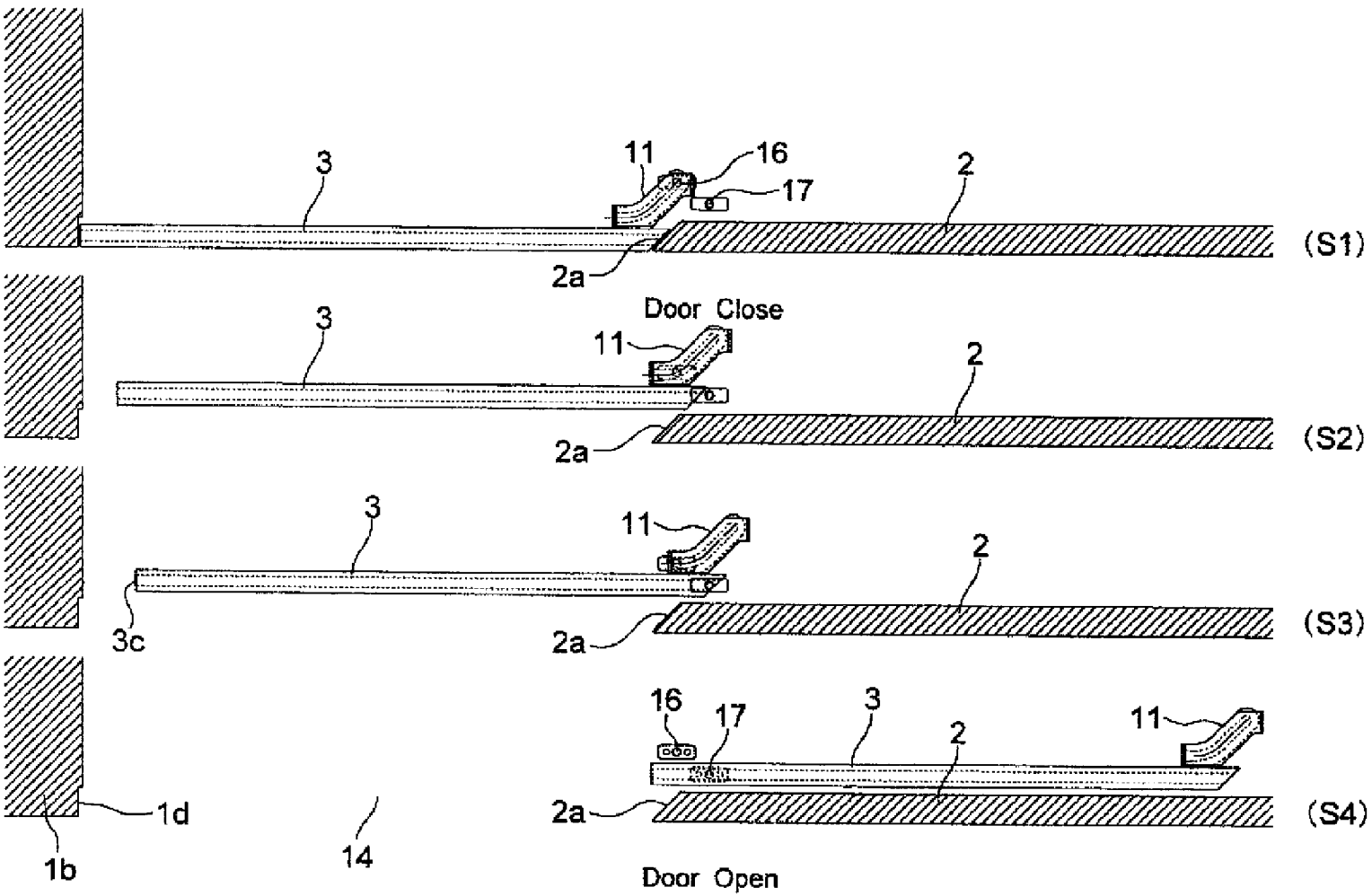
FIG. 9 is a plan view illustrating opening and closing motions of the lower part of the sliding door in chronological order.
Figure 10:
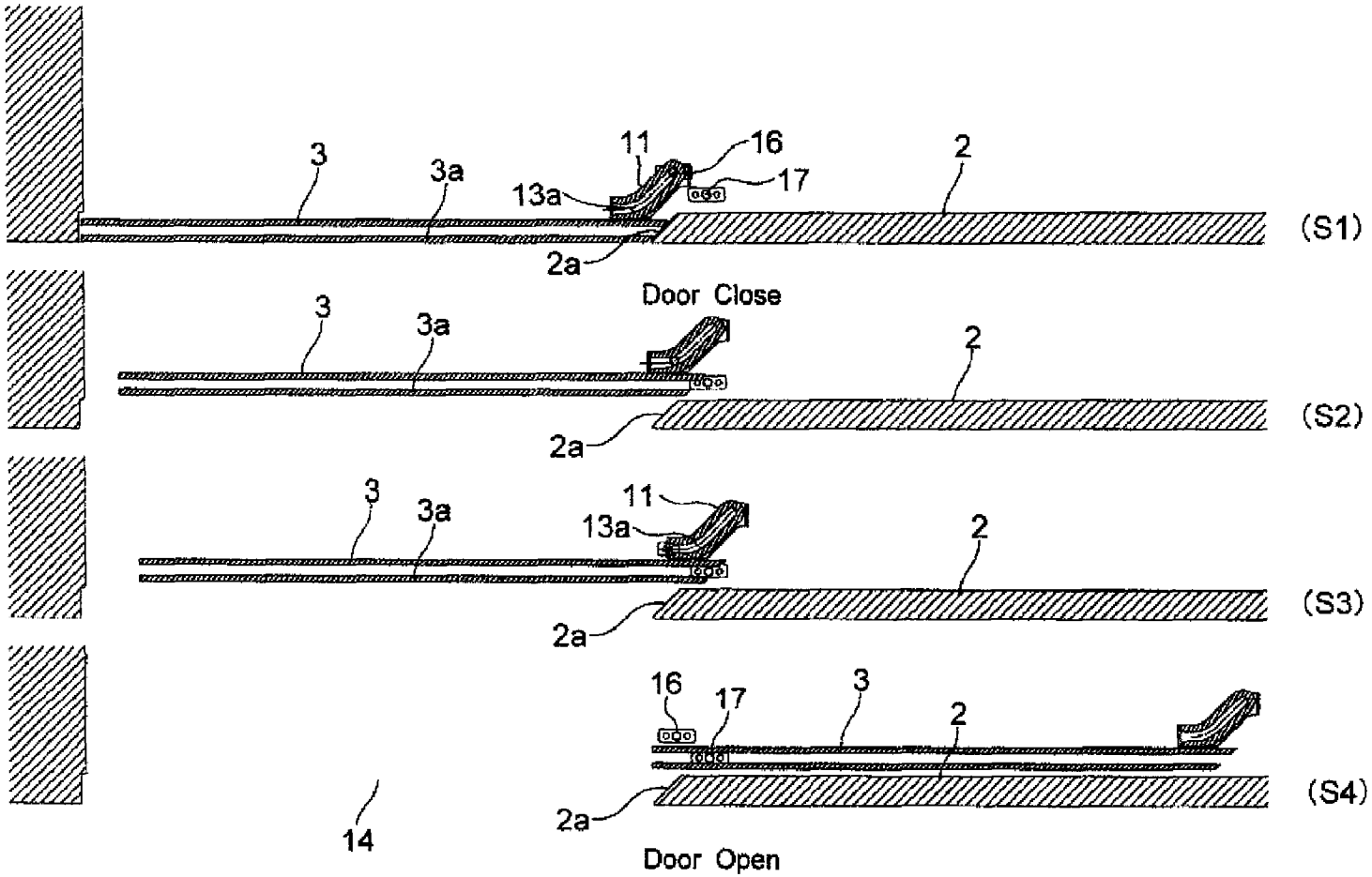
FIG. 10 is a horizontal cross-sectional view of FIG. 9.
Figure 11:
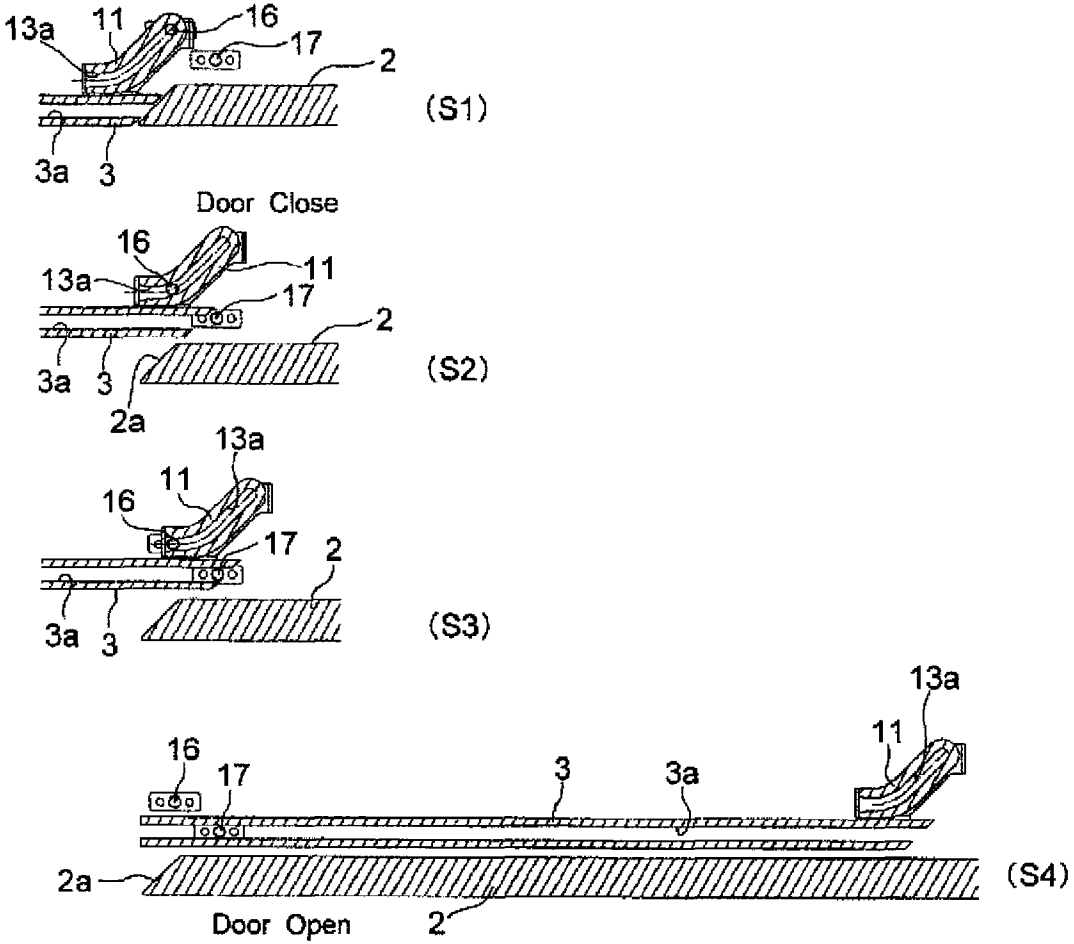
FIG. 11 is an enlarged view of a substantial part of FIG. 10.

FIGS. 9 to 11 are views illustrating the opening and closing motions of the lower part of the sliding door 3 in chronological order. FIG. 9 is a plan view, FIG. 10 is a horizontal cross-sectional view and FIG. 11 is an enlarged view of a substantial part. When the sliding door 3 is in closed position, the first pin body 16 is fit in the guide groove 13*a* of the guide member 11 (S1). At this time, the first pin body 16 is positioned at the backmost part of the guide groove 13*a*. The second pin body 17 is exposed and not fit in the sliding door groove 3*a* of the sliding door 3. The end surface of the sliding door 3 is cut obliquely so as to conform to the end surface 2*a* of the wall 2.

When the sliding door 3 in the closed position is slid in the obliquely backward direction, the guide member 11 moves along the first pin body 16 while the first pin body remains in the guide groove 13*a* of the guide member 11 (S2). At this time, the sliding door groove 3*a* becomes close to the second pin body 17 gradually.

When oblique sliding of the sliding door 3 is finished, the sliding door 3 starts to slide straightly in parallel with the wall 2 (S3). The first pin body 16 remains fit in the guide groove 13*a* but moves toward the open end side of the guide groove 13*a* in parallel with the wall. In concurrence with this, the sliding door groove 3*a* of the sliding door 3 fits on the second pin body 17. Immediately after the second ping body 17 gets fit in the sliding door groove 3*a* of the sliding door 3, the first pin body 16 gets out of the guide groove 13*a* of the guide member 11.

When the sliding door 3 is slid further in the opening direction, the sliding door 3 slides along the second pin body 17 while the second pin body 17 remains fit in the sliding door groove 3*a* of the sliding door 3 (S4). Finally, the sliding door 3 comes into the open position. When the sliding door 3 in the open position is to be closed, the above-described operations are performed in the reverse order, like from S4 to S1.

When seen from the front side of the sliding door 3, the first pin body 16 does not jut inside the opening and is hidden behind the wall. This is because the first pin body 16 is prevented from jutting into the opening which people pass through. The guide groove 13*a* of the guide member 11 protrudes in the width direction of the sliding door 3 so as to fit on the first pin body 16 jutting from the opening 14. As the guide member 11 protrudes from the sliding door 3, the guide member 11 functions as a door stopper.

Figure 12:
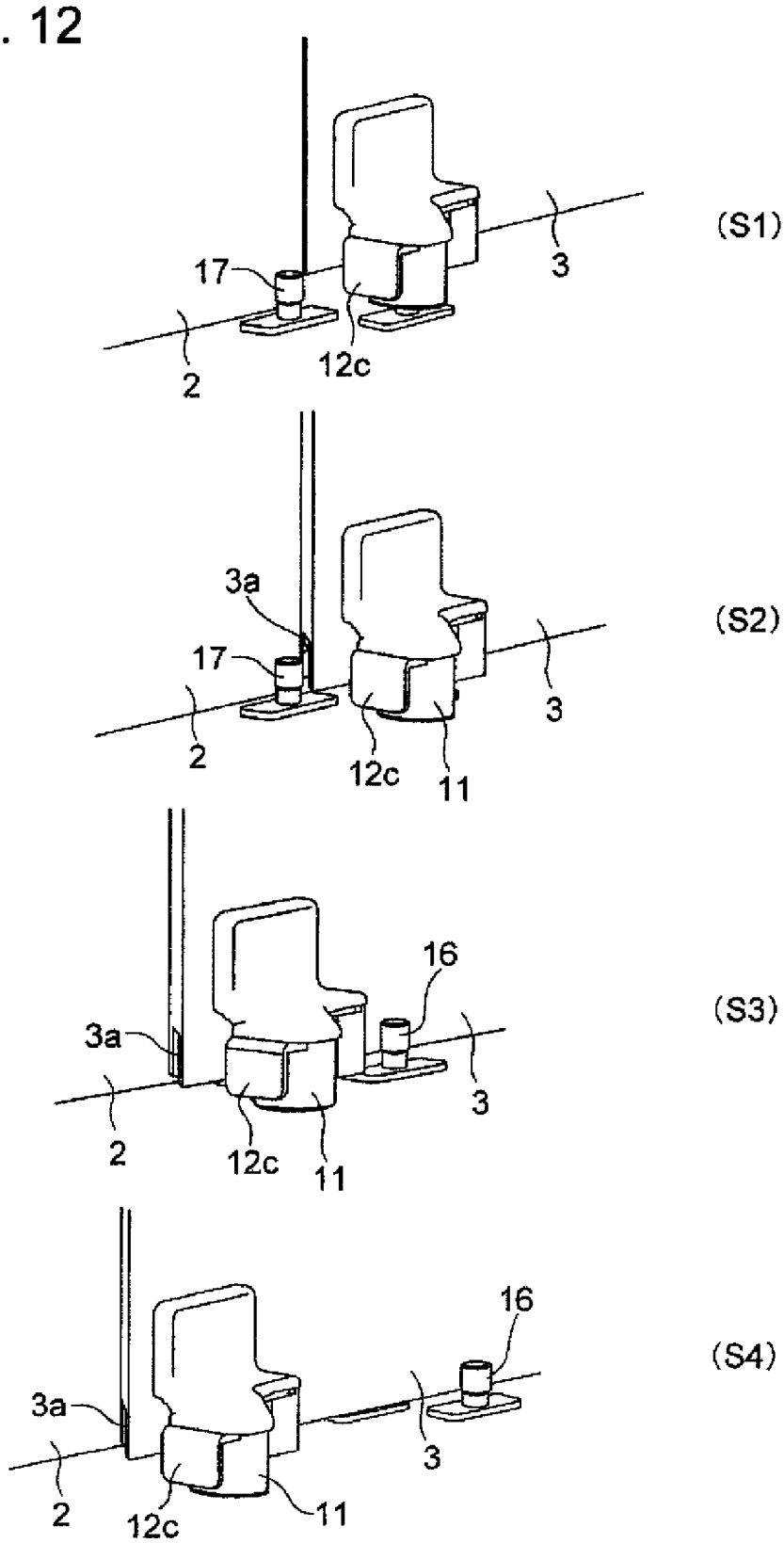
FIG. 12 is a perspective view illustrating the motions of the lower part of the sliding door in chronological order.

FIG. 12 is a perspective view illustrating the motions of the lower part of the sliding door 3 in chronological order. As described above, when the sliding door 3 is in the closed position, the first pin body 16 is fit in the guide groove 13*a* of the guide member 11 and the second pin body 17 is exposed (S1). When the sliding door 3 is slid in the obliquely backward direction, the sliding door groove 3*a* of the sliding door 3 comes closer to the second pin body 17 (S2). Then, when the sliding door 3 is slid straightly, the sliding door groove 3*a* of the sliding door 3 is fit on the second pin body 17 and the sliding door 3 is guided by the second pin body 17 (S3). When the sliding door 3 is slid further straightly, the first pin body 16 is exposed from the guide member 11. The second pin body 17 continues to guide the sliding door 3 until the sliding door 3 gets in the open position.

According to the sliding door device of the present embodiment, when the sliding door 3 in the closed position is to be opened, the sliding door 3 is first guided by the first pin body 16 (see S1 and S2). Then, the guiding of the sliding door 3 is switched from the first pin body 16 to the second pin body 17 (S3) and after switching, the second pin body 17 guides the sliding door 3 (S4). As switching is performed between the first pin body 16 and the second pin body 17, the sliding door 3 can be guided both in the obliquely backward direction and in the straight direction. Then, as the sliding door 3 is always guided by the first pin body 16 or the second pin body 17 from the closed position to the open position and vice versa, the lower part of the sliding door 3 is not shaken when the sliding door 3 is in the closed position. When the sliding door 3 is in the closed position, the end part 3*c* of the vertical side of the sliding door 3 is fit in the step gap 1*d* of the vertical part 1*b*, and the end part 3*c* of the vertical side is also prevented from shaking.

Figure 13:
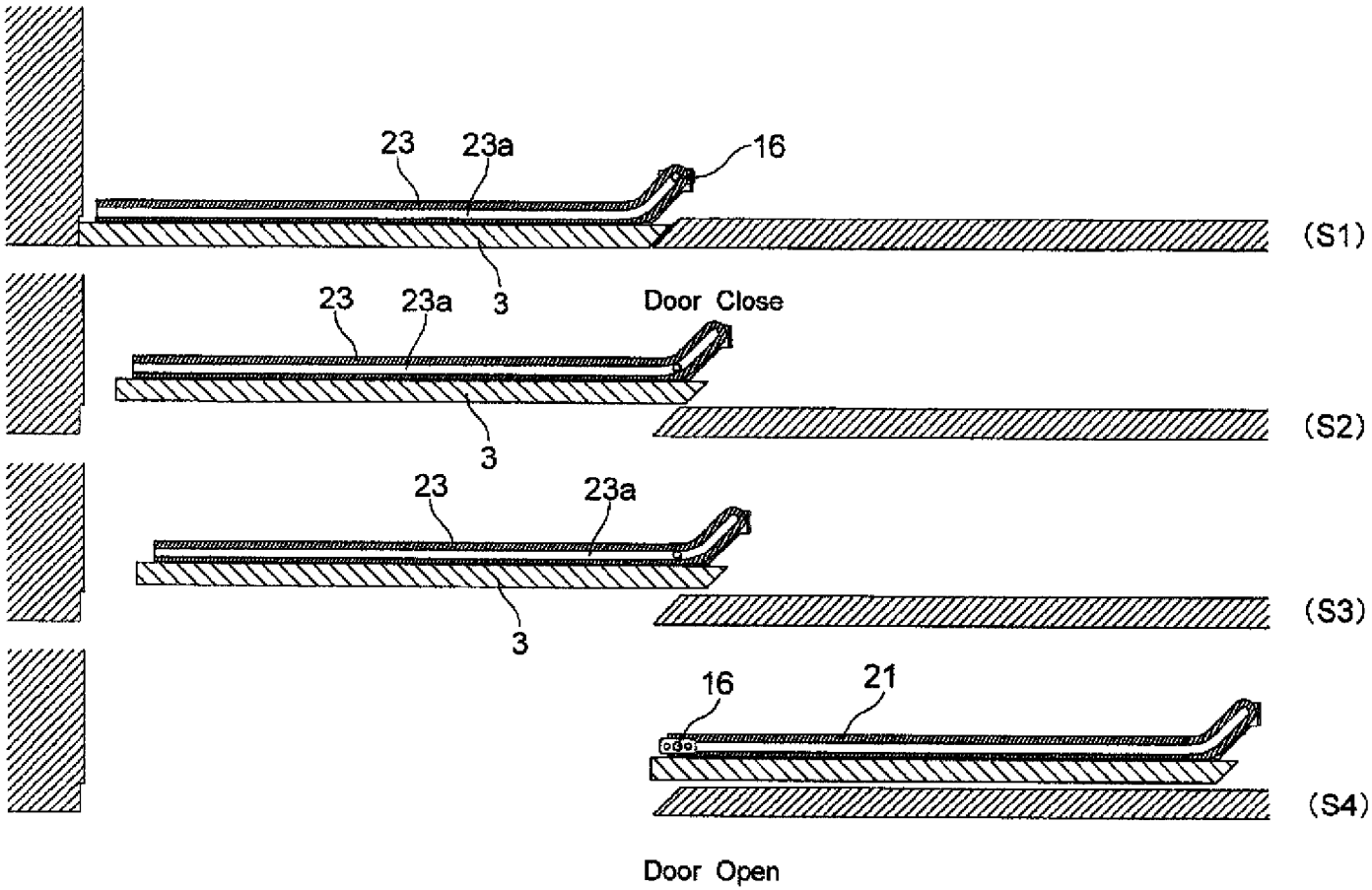
FIG. 13 is a view illustrating a sliding door device according to another embodiment (horizontal cross-sectional view illustrating the opening and closing motions of the lower part of the sliding door in, chronological order)
Figure 14:
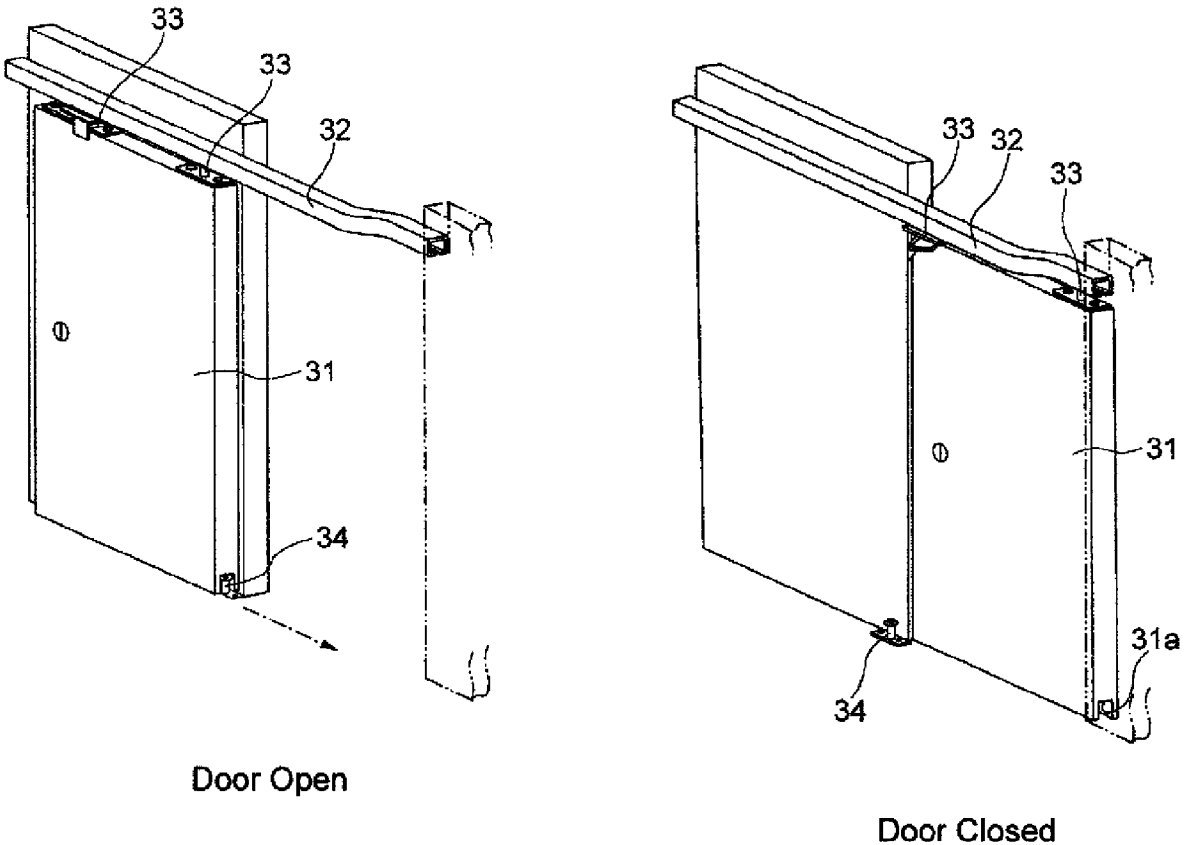
FIG. 14 Background Art
FIG. 14 is perspective view illustrating a conventional sliding door device.

FIG. 13 illustrates a sliding door device according to another embodiment of the present invention. In the sliding door device of this embodiment, a thin guide member 23 extends the length of the sliding door 3. The guide member 23 has a guide groove 23*a* formed in the longitudinal direction. The first pin body 16 is fit in this guide groove 23*a*. The second pin body 17 is not provided on the floor and the sliding door groove 3*a* is not provided at the bottom surface of the sliding door 3. Sliding in the obliquely backward direction of the sliding door 3 is guided only by the first pin body 16 (S1, S2) and the straight sliding is also guided only by the first pin body 16 (S3, S4). Also with the sliding door device according to this embodiment, the sliding door 3 is always guided by the first pin body 16 from the closed position to the open position, and vice versa, and the lower part of the sliding door 3 is not shaken when the sliding door 3 is closed. Further, as the guide groove is formed in the guide member mounted on the sliding door 3, it is possible to prevent any dust or waste from accumulating in the guide groove.

The present invention is not limited to the above-described embodiments and may be modified into various forms without departing from the scope of the present invention. For example, in sliding door device according to the first embodiment where the first and second pin bodies are switched, the first pin body may be mounted on the sliding door and the guide member may be mounted on the floor surface.

In addition, though the two guide rails are provided, these may be changed to one guide rail having a pair of pulling-in rails blanched at a midpoint. If one guide rail is provided, attention has to be paid so that the roller unit is sure to roll from the main rail to the branched rails.

Further, the sliding door may not be slid in the oblique direction when the sliding door start to be opened, and it may slid first to the back side and then in the opening direction that is 90 degrees bent therefrom, Further, in place of combination of the wall and the sliding door, two open/close sliding doors may be provided close to each other and combined. In this case, a pair of sliding door devices is arranged symmetrically.

Furthermore, in the above-mentioned embodiment, the sliding door groove is formed in the bottom of the sliding door and the second pin body for fitting into the sliding door groove is fixed to the floor surface. However, the second pin may be fixed to the bottom of the sliding door and a floor surface side guide groove maybe provided on in the floor surface for fitting of the second pin body. The floor surface side guide groove maybe directly engraved on the floor surface or a guide member having the floor surface side guide groove formed therein may be mounted on the floor surface. In the case where the floor surface side guide groove is engraved on the floor surface, the second pin body may be movable horizontally relative to the sliding door so that the second pin body can be fit in or get out of the floor surface side guide groove.

The present application is based on Japanese Patent Application No. 2007-054738 filed on Mar. 5, 2007, and its contents are incorporated by reference herein.

The invention claimed is:

1. A sliding door device capable of making a surface of a sliding door in a closed position in plane with a wall surface and arranging the sliding door in an open position on a back side or a front side of the wall surface and in parallel with the wall surface, the sliding door device comprising:

a first pin body provided on a floor surface;

a guide member provided on the sliding door and having a guide groove in which the first pin body fits when the sliding door is in the closed position; and a second pin body that is provided on the floor surface and can be fit in a sliding door groove formed at a bottom part of the sliding door, wherein, when the sliding door in the closed position is slid in an opening direction and toward the back side or front side of the wall surface, the guide member moves relatively along the first pin body while the first pin body is fit in the guide groove of the guide member, when the sliding door is further slid in the opening direction, the second pin body gets in the sliding door groove of the sliding door and the sliding door slides along the second pin body while the second pin body is fit in the sliding door groove of the sliding door, the first pin body does not jut in an opening when seen from a front side of the sliding door, and at least a part of the guide member protrudes in a width direction of the sliding door when seen from the front side of the sliding door.

2. The sliding door device of claim 1, wherein after the second pin body gets in the sliding door groove of the sliding door, the first pin body gets out of the guide groove of the guide member.

3. A sliding door system comprising:

the sliding door device of claim 2;

a frame having a wall surface; and a sliding door accommodated in the frame to be openable and closable.

4. The sliding door device of claim 1, wherein the guide member is provided with a door stopper at the part of the guide member protruding in a width direction of the sliding door when seen from the front side of the sliding door.

5. A sliding door system comprising:

the sliding door device of claim 4;

a frame having a wall surface; and a sliding door accommodated in the frame to be openable and closable.

6. A sliding door system comprising:

the sliding door device of claim 1;

a frame having a wall surface; and a sliding door accommodated in the frame to be openable and closable.

7. A sliding door device capable of making a surface of a sliding door in a closed position in plane with a wall surface and arranging the sliding door in an open position on a back side or a front side of the wall surface and in parallel with the wall surface, the sliding door device comprising:

a first pin body provided on a floor surface; and a guide member provided on the sliding door and having a guide groove in which the first pin body fits when the sliding door is in the closed position;

wherein the guide member moves along the first pin body while the first pin body is fit in the guide groove of the guide member when the sliding door moves from the closed position to the open position, the first pin body does not jut in an opening when seen from a front side of the sliding door, and at least a part of the guide member protrudes in a width direction of the sliding door when seen from the front side of the sliding door.

8. A sliding door system comprising:

the sliding door device of claim 7;

a frame having a wall surface; and a sliding door accommodated in the frame to be openable and closable.

9. The sliding door device of claim 7, wherein the guide member is provided with a door stopper at the part of the guide member protruding in a width direction of the sliding door when seen from the front side of the sliding door.

* * * * *

UNITED STATES PATENT AND TRADEMARK OFFICE

CERTIFICATE OF CORRECTION

PATENT NO. : 8,375,645 B2
APPLICATION NO. : 12/530335
DATED : February 19, 2013
INVENTOR(S) : Iwauchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 502 days.

Signed and Sealed this
First Day of September, 2015

Michelle K. Lee

Michelle K. Lee
*Director of the United States Patent and Trademark Office*